US009335037B2

(12) United States Patent
Peeters et al.

(10) Patent No.: US 9,335,037 B2
(45) Date of Patent: May 10, 2016

(54) CONTROL INTERFACE MODULE FOR A LIGHTING MODULE

(71) Applicant: KONINKLIJKE PHILIPS N.V., Eindhoven (NL)

(72) Inventors: Henricus Marie Peeters, Baarlo (NL); Wouter Petrus Kaandorp, Best (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/366,961

(22) PCT Filed: Dec. 17, 2012

(86) PCT No.: PCT/IB2012/057382

§ 371 (c)(1),
(2) Date: Jun. 19, 2014

(87) PCT Pub. No.: WO2013/093758

PCT Pub. Date: Jun. 27, 2013

(65) Prior Publication Data

US 2014/0369043 A1 Dec. 18, 2014

Related U.S. Application Data

(60) Provisional application No. 61/577,383, filed on Dec. 19, 2011.

(51) Int. Cl.

| | |
|---|---|
| ***F21S 4/00*** | (2006.01) |
| ***F21V 21/00*** | (2006.01) |
| ***F21S 13/02*** | (2006.01) |
| ***F21S 13/12*** | (2006.01) |
| ***F21V 23/06*** | (2006.01) |
| ***F21V 19/00*** | (2006.01) |

(Continued)

(52) U.S. Cl.
CPC . *F21V 23/06* (2013.01); *F21K 9/30* (2013.01); *F21V 19/006* (2013.01);

(Continued)

(58) Field of Classification Search
CPC ..... F21K 9/30; F21V 23/003; F21V 23/0435; F21V 23/06; F21V 23/008; F21V 19/006; H01R 33/9456; F21Y 2101/02
USPC ..... 362/257, 277, 249.11
See application file for complete search history.

(56) References Cited

U.S. PATENT DOCUMENTS

| | | | |
|---|---|---|---|
| 5,121,287 | A | 6/1992 | Lee |
| 6,093,983 | A | 7/2000 | Singh |

(Continued)

FOREIGN PATENT DOCUMENTS

| | | | |
|---|---|---|---|
| CN | 2481957 | Y | 3/2002 |
| CN | 201437964 | U | 4/2010 |

(Continued)

*Primary Examiner* — Donald Raleigh
(74) *Attorney, Agent, or Firm* — Meenakshy Chakravorty

(57) ABSTRACT

The present invention relates to a control interface module (200) adapted to receive a lighting module (100) and to be fitted to a holder (300) by means of at least one fixating element provided through the control interface module (200) and into the holder (300), wherein the holder (300) comprises electrical connecting elements (308) for providing electrical power to the lighting module (100) and mechanical connecting elements (104, 104', 104") for fixating the lighting module (100), wherein the control interface module (200) comprising an inner surface(202) having at least one recess (204) matching a recess (304) arranged in the holder (300), wherein the at least one recess (204) is configured to receive a corresponding protruding portion (104) of the lighting module (100), a control signal input interface (214) adapted to receive at least one wire adapted to convey a control signal from a control unit, and a control signal output interface (216) adapted to receive a control signal connector (108) of the lighting module (100) and to provide the control signal to the lighting module (100).

11 Claims, 2 Drawing Sheets

(51) Int. Cl.

| | |
|---|---|
| ***F21V 23/00*** | (2015.01) |
| ***F21V 23/04*** | (2006.01) |
| ***H01R 33/945*** | (2006.01) |
| ***F21K 99/00*** | (2016.01) |
| *F21Y 101/02* | (2006.01) |

(52) U.S. Cl.

CPC ..... *F21V 23/003* (2013.01); *F21V 23/008* (2013.01); *F21V 23/0435* (2013.01); *H01R 33/9456* (2013.01); *F21Y 2101/02* (2013.01)

(56) References Cited

U.S. PATENT DOCUMENTS

| | | | | |
|---|---|---|---|---|
| 6,494,730 | B1 * | 12/2002 | Yan | 439/226 |
| 6,702,454 | B2 * | 3/2004 | Grajetzky et al. | 362/365 |
| 7,123,140 | B1 | 10/2006 | Denes | |
| 8,313,219 | B2 * | 11/2012 | Newman et al. | 362/365 |
| 2009/0185381 | A1 * | 7/2009 | Willwohl et al. | 362/294 |
| 2011/0261572 | A1 * | 10/2011 | Watanabe et al. | 362/373 |
| 2012/0106177 | A1 * | 5/2012 | Blankestijn et al. | 362/382 |
| 2012/0282815 | A1 * | 11/2012 | Aurongzeb | H01R 13/625 439/660 |
| 2013/0083511 | A1 * | 4/2013 | Osada et al. | 362/95 |

FOREIGN PATENT DOCUMENTS

| | | | |
|---|---|---|---|
| WO | 2010111672 | A1 | 9/2010 |
| WO | 2010146513 | A1 | 12/2010 |
| WO | WO 2010146509 | A1 * | 12/2010 |

* cited by examiner

CONTROL INTERFACE MODULE FOR A LIGHTING MODULE

CROSS-REFERENCE TO PRIOR APPLICATIONS

This application is the U.S. National Phase application under 35 U.S.C. §371 of International Application No. PCT/IB2012/057382, filed on Dec. 17, 2012, which claims the benefit of [e.g., U.S. Provisional Patent Application No. or European Patent Application No.] 61/577,383, filed on Dec. 19, 2011. These applications are hereby incorporated by reference herein.

FIELD OF THE INVENTION

The present invention relates to the field of lighting, and more specifically to a control interface module adapted to receive a lighting module, where the control interface module is provided for allowing characteristics of light emitted by a light source of the lighting module to be varied. The present invention also relates to a corresponding lighting module which is susceptible for connection to the control interface module, as well as to a lighting arrangement comprising a lighting module and a control interface module.

BACKGROUND OF THE INVENTION

Light emitting diodes, LEDs, are employed in a wide range of lighting applications. As LEDs have the advantage of providing a bright light, being reasonably inexpensive and drawing very little power, it is becoming increasingly attractive to use LEDs as an alternative to traditional lighting. Furthermore, LEDs have a long operational lifetime. As an example, LED lamps may last 50 000 hours which is up to 50 times the operational life of an incandescent lamp.

The development of LEDs is rapidly moving forward and there has hence been a further need of providing standardized holders for mounting and electrically connecting LED modules (e.g. comprising a plurality of LEDs), similar to e.g. the T-standard for fluorescent lamps, thereby allowing exchangeability between e.g. different LED modules providing different functionality.

One approach of such a standard may enable for interchangeability between products made by diverse LED manufacturers. Such a standard thus provides for a standardized fit between the LED module and a socket. Furthermore, the mains connectors are then connected to the socket for providing electrical power to the LED.

Although such a standardization increases the interchangeability for the costumers, there is still a further need of improvement.

SUMMARY OF THE INVENTION

It is an object of the present invention to provide a control interface module for a lighting module in order to vary the characteristics of light provided by the lighting module.

According to an aspect of the present invention there is provided a control interface module adapted to receive a lighting module and to be fitted to a holder by means of at least one fixating element provided through the control interface module and into the holder, wherein the holder comprises electrical connecting elements for providing electrical power to the lighting module and mechanical connecting elements for fixating the lighting module to the socket, wherein the control interface module comprises an inner surface having at least one recess matching a recess arranged in the holder, wherein the at least one recess is configured to receive a corresponding protruding portion of the lighting module, a control signal input interface adapted to receive at least one wire adapted to convey a control signal from a control unit, and a control signal output interface adapted to receive a control signal connector of the lighting module and to provide the control signal to the lighting module.

The present invention is based on the insight that a control interface module may be provided to the holder for the lighting module. The control interface module may thus provide for an increased control of the characteristics of e.g. the light emitted by a light source of the lighting module. An advantage of the invention is, at least, that the control interface module may be connected to a holder having an already predefined mechanical and electrical interface for receiving the lighting module, i.e. the control interface module is provided with mechanical properties so that it fulfills the modularity standards of a lighting module. Also, the control interface module may thus enable for adjustment of the characteristics of the light emitted by a light source arranged in the lighting module. Hence, the lighting module may still be provided with electrical power from e.g. mains connectors via the holder and the control interface module may thus only be configured to allow control of the light characteristics. Such light characteristics may, for example, be the luminous intensity of the light source.

Hereby, the light source may be controlled in respect of e.g. a dimming level, speed of fading, color of light, etc. Also, in the case of several light sources arranged in the lighting module, each light source may be individually controlled so that, for example, one light source may be given a signal to fade while another light source may be given the signal to increase its luminous intensity, etc. Hence, the control interface module may be provided for a lighting module utilizing a certain standard and at the same time enables for further desirable characteristic features of the light emitted by the light source in the lighting module.

The wording "convey" should be interpreted in such a way that the control signal input interface is configured to receive a signal from e.g. an external control unit and to provide it to the lighting module via the control signal output interface. Hereby, the characteristics of the light emitted by the light source of the lighting module may thus be controlled by the control unit. It should however be noted that the control unit which provides the signal to the control signal input interface may be provided as a component within the lighting module. Furthermore, a user of the lighting module may hence control the characteristics of the light emitted by the light source of the lighting module by, for example, a remote control, a switch coupled to the control unit, etc. The control unit may, for example, be connected to a DALI interface, DMX interface, PWM interface, TTL logic, etc.

Furthermore, the fixating elements adapted to fit the control interface module to the holder may be provided in a number of ways, for example, by providing a screw connection between the control interface module and the holder, a clip connection attached to the control interface module and thereafter snapped to the holder, etc. Furthermore, the recesses in the control interface module and the holder may be arranged such that the lighting module is fixated to the holder by means of e.g. a bayonet fitting at a bottom section of the holder.

According to an embodiment, the control interface module may further comprise three spaced apart recesses, wherein each recess is positioned circumferentially on the inner surface of the control interface module.

Furthermore, the recesses may be positioned at 120° interval from each other. Hereby, the recesses may be formed to fulfill a certain standard.

The lighting module may fulfill the specifications of a certain standard, which allows a user or operator of the lighting module to change between various brands of an LED light engine without the need of changing the holder. The modularity provided by such a standard may thus be maintained for the control interface module. Also, the control interface module may thus also be adapted to receive lighting modules which are not provided with the above mentioned control signal connector. Hereby, having the control interface module fitted to the holder may still enable for a standard lighting module without the ability of being controlled in respect of e.g. dimming or shading etc.

According to another aspect of the present invention there is provided a lighting module having at least one light source and configured to be fitted to a holder and a control interface module, wherein the lighting module further comprises an outer surface having at least one protruding portion adapted to be provided through a corresponding recess arranged in the holder, electrical contact elements adapted to fit to corresponding electrical connecting elements arranged in the holder for providing electrical power to the lighting module, and a control signal connector adapted to receive a control signal output interface of the control interface module for receiving a control signal to the lighting module.

Hereby, a lighting module is provided which may be fitted to e.g. the control interface module as described above. The lighting module may thus be susceptible for receiving a control signal via the signal input interface and the signal output interface so that e.g. the characteristics of light emitted from a light source of the lighting module may be varied in a number of different ways. For example, as also described above, the luminous intensity of the light emitted from the light source may be varied. It should however be noted that the invention is not limited to a lighting module having only one light source, a plurality of light sources may be provided in the lighting module. Hereby, each light source may be individually controlled as described above in relation to the other aspect of the invention. Furthermore, the lighting module may also be connected to the holder without having the above described adapter arranged thereto, i.e. a standard arrangement, which fulfills specifications of a standard.

Moreover, the lighting module may be provided with a control unit which may be configured to detect if a control interface module is connected to the lighting module. Hereby, the control unit may thus, if the lighting module is connected to a control interface module, adjust the characteristics of the light emitted by the light source(s) of the lighting module based on a signal received from e.g. a DALI interface, DMX interface, PWM interface, TTL logic, etc. On the other hand, if the control unit does not detect the presence of the control interface module, the lighting module may still be able to work as an ordinary lighting module, without the ability of controlling e.g. various characteristic features of the emitted light. Hereby, the lighting module may thus be configured to fulfill the standard requirements in order to fit to standard holders which are fulfill the specifications of a certain standard.

Moreover, the lighting module may comprise three spaced apart protruding portions, wherein each protruding portion is positioned circumferentially on the outer surface of the lighting module. Hereby, the protruding portions may be arranged to be fitted to corresponding recesses arranged in the control interface module and the holder. Furthermore, the protruding portions may be fixated to the holder by means of e.g. a bayonet coupling.

Furthermore, the protruding portions may be positioned at 120° interval from each other. Hereby, the protruding portions may be formed such that they fulfill the specifications of a certain standard.

According to an exemplifying embodiment of the present invention, the control signal connector may be provided with a protecting element adapted to be automatically removed when the lighting module is fitted to the control interface module. An advantage of having a protecting element arranged on the control signal connector is, at least, that the control signal connector may be protected from external damage prior to being provided to the control interface module. Also, in the event the lighting module is fitted to a holder which does not include a control interface module, the control signal connector may be protected from being accidentally damage after being mounted. Furthermore, the protecting element may be configured in such a way that when the lighting module is fitted to the control interface module, the control interface module may touch the protecting element in such a way that the protecting element falls off from the control signal connector. Thereafter, a control signal output interface of the control interface module may be connected to the control signal connector of the lighting module.

Furthermore, electrical power may be provided to the lighting module by means of mains connectors arranged in the holder. Hereby, electrical power is provided to the lighting module in a convenient and well established manner.

Other effects and features of this aspect of the invention provide similar advantages as discussed above in relation to the previous aspect of the invention.

According to a still further aspect of the present invention there is provided a lighting arrangement comprising the above mentioned holder and control interface module as well as the above mentioned lighting module. Effects and features of this aspect are largely analogous to those described above in relation to the other aspects of the present invention.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing example embodiments of the invention, wherein.

DESCRIPTION OF AN EXAMPLE EMBODIMENT OF THE PRESENT INVENTION

Figure 1:
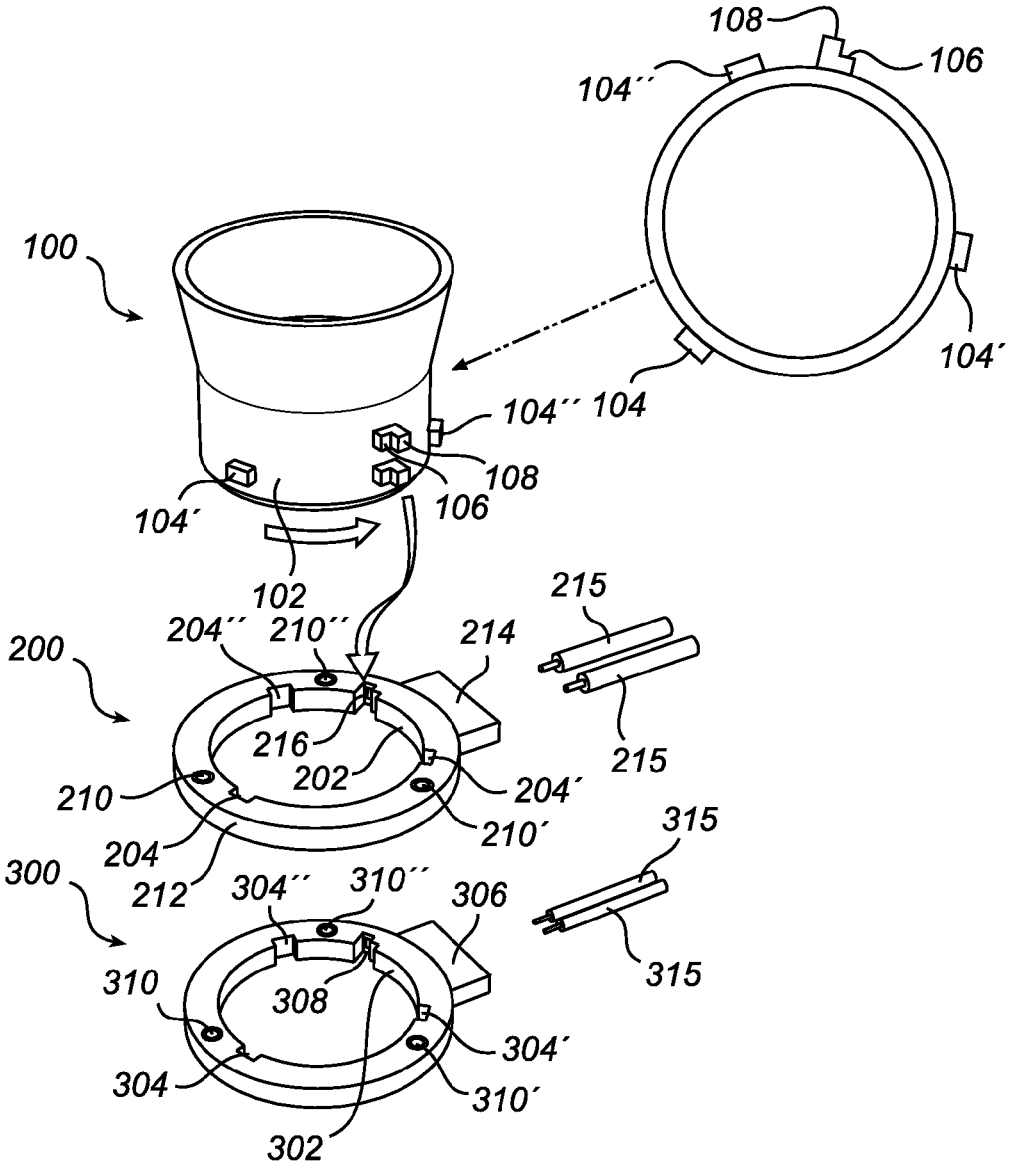
FIG. 1 illustrates an exploded perspective view of a lighting module adapted to be fitted to a control interface module and a holder according to a currently preferred embodiment of the present invention.

The present invention will now be described more fully hereinafter with reference to the accompanying drawings, in which a currently preferred embodiment of the invention is shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted an exploded perspective view of a lighting module 100, a control interface module 200 and a holder 300 according to a currently preferred embodiment of the invention. As is illustrated in the exemplary embodiment of Fig. 1, the lighting module 100 is circularly shaped having an outer surface 102. The outer surface 102 of the lighting module 100 comprises three spaced apart mechanical connecting elements, here illustrated as protruding portions 104, 104', 104" which are, in the illustrated example embodiment, located circumferentially within an interval of approximately 120°. The protruding portions 104, 104', 104" are arranged to, when being mounted to the control interface module 200 and the holder 300, be fitted to corresponding recesses 204, 204', 204", 304, 304', 304" arranged in the control interface module 200 and the holder 300, which will be described further below. Moreover, the lighting module further comprises electrical contact elements 106 on a lower end of the outer surface 102. The electrical contact elements 106 are arranged to receive electrical power and to provide the electrical power to a light source (not shown) arranged in the lighting module 100. The light source arranged in the lighting module may, for example be, an LED or a plurality of LEDs. Also, at a position located approximately above the electrical contact element 106 is arranged a control signal connector 108. The control signal connector 108 comprises electrically conductive elements which are arranged to convey control signals to the light source arranged in the lighting module 100. The control signal connector 108 may, prior to being connected to the control interface module 200, be provided with a protecting element 208, which will be described in more detail below in relation to the description of FIG. 2.

Reference is now made in particular to the control interface module 200 and the holder 300 illustrated in FIG. 1. The holder 300 is arranged to be connected to e.g. a roof or wall etc, and to fixate the lighting module 100 so that the lighting module is arranged at a desired position in, for example, an apartment, an office space, etc. The holder 300 comprises an inner surface 302 having an approximately similar diameter as the outer surface 102 of the lighting module 100. Furthermore, in order to be able to receive and fixate the lighting module 100 to the holder 300, the holder 300 further comprises, in the illustrated example embodiment, three spaced apart recesses 304, 304', 304" on its inner surface 302. The spaced apart recesses 304, 304', 304" are located circumferentially within an interval of approximately 120° and are thus adapted to match with the above mentioned protruding portions 104, 104', 104" of the lighting module 100. Also, each of the recesses 304, 304', 304" in the holder further comprises a curve-shaped opening so that the lighting module can be fixated to the holder by means of twisting the protruding portions 104, 104', 104"into the curve-shaped openings, e.g. like a bayonet fitting.

The holder 300 further comprises electrical receiving elements 306 on an outer surface. The electrical receiving elements 306 may, for example, be mains connectors and are adapted to be connected to an external power source through wires 315. Furthermore, the electrical receiving elements 306 are further connected to electrical connecting elements 308 arranged at the inner surface 302 of the holder 300. These electrical connecting elements 308 are adapted to be connected to the corresponding contact elements 106 on the lighting module 100 for providing electrical power to the light source arranged in the lighting module 100. Still further, the holder 300 also comprises, in the illustrated embodiment, three attachment portions 310, 310', 310". These attachment portions 310, 310', 310" are configured to mate with corresponding attachment portions of the control interface module 200. Hereby, the control interface module 200 can be fitted to the holder by means of the attachments portions, for example, by a screw or bolt arranged through the attachment portions. This may preferably be executed at the factory where the holder and module are manufactured, although the assembly of the holder and control interface module of course also may be executed at site where the lighting module is to be provided, such as an office space, apartment, etc.

Reference is now in particular made to the control interface module 200. As is illustrated in the exemplifying embodiment of FIG. 1, the control interface module 200 comprises three spaced apart recesses 204, 204', 204" as described above. The recesses 204, 204', 204" in the control interface module 200 are, as well as for the holder 300, located circumferentially within an interval of approximately 120° on an inner surface 202 of the control interface module 200 and are, when the control interface module 200 is fitted to the holder 300, arranged to mate with the recesses 304, 304', 304" of the holder 300. Hence, when the control interface module 200 is fitted to the holder 300, the protruding portions 104, 104', 104" of the lighting module 100 are arranged to pass through the respective recesses of the control interface module 200 and the holder 300 for fixation of the lighting module 100. Moreover, similar to holder 300, the control interface module 200 also comprises three attachment portions 210, 210', 210" which are arranged to mate with the attachment portions 310, 310', 310" of the holder 300. Hereby, as described above, the control interface module 200 can be fitted to the holder 300 by means of e.g. screws or bolts arranged through the respective attachment portions.

The control interface module 200 further comprises on its outer surface 212 a control signal input interface 214. The control signal input interface 214 is arranged to receive at least one wire 215 from a control unit. The control unit may, for example, be connected to a DALI interface or the like. Moreover, the control signal input interface 214 is further connected to a control signal output interface 216 arranged on the inner surface 202 of the control interface module 200. The control signal output interface 216 is adapted to be connected to the control signal connector 108 of the lighting module 100. Hereby, a control signal from the control unit is thus adapted to be conveyed from the control unit to the light source of the lighting module 100 via the control signal input interface 214 and the control signal output interface 216.

Figure 2:
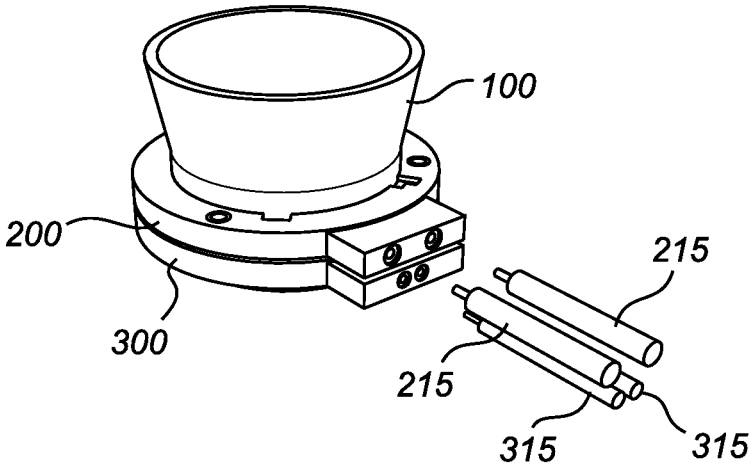
FIG. 2 illustrates a perspective view of the lighting module connected to a holder and a control interface module according to a currently preferred embodiment of the present invention.

In order to summarize the connection of the lighting module 100 to the control interface module 200 and the holder 300, with further reference to Fig 2, the protruding portions 104, 104', 104" of the lighting module 100 are provided through the corresponding recesses 204, 204', 204", 304, 304', 304" arranged in the control interface module 200 and the holder 300. The protruding portions 104, 104', 104" may be further connected to the holder 300 by means of e.g. a bayonet fitting, in order to fixate the lighting module 100 to the holder 300. When the lighting module 100 is mounted and fixated to the holder 300, the electrical contact elements 106 of the lighting module are connected to the electrical connecting elements 308 of the holder 300, and the control signal connector 108 is connected to the control signal output interface 216 of the control interface module 200. Hereby, electrical power as well as control of e.g. the characteristics of light from the light source(s) is provided to the lighting module 100.

Figure 3:
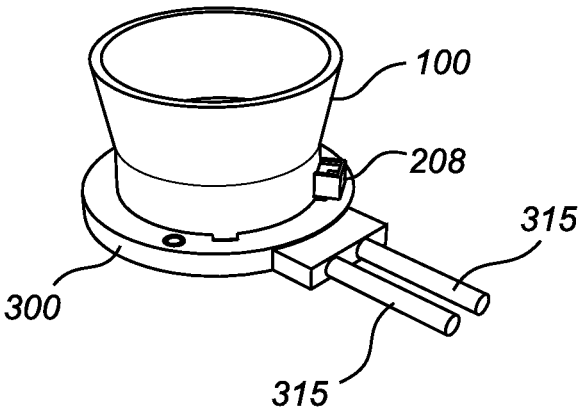
FIG. 3 illustrates a perspective view of the lighting module connected to a holder according to a currently preferred embodiment of the present invention.

Reference is now made to FIG. 3, which illustrates a perspective view of the lighting module connected to a holder according to an example embodiment of the present invention. In the illustrated example embodiment of FIG. 3, the lighting module 100 is fixated to the holder 300 without having a control interface module 200 connected thereto. The lighting module 100 may hence be compatible for connection to a standard holder, which fulfills the specifications of a certain standard. Moreover, the control signal connector 108 is provided with a protecting element 208. The protecting element 208 is adapted to provide protection of the control signal connector 108 against e.g. external damage when the lighting module 100 is connected to a holder 300 without the control interface module 200. The protecting element 208 may also serve as a protection prior to fixating the lighting module 100 to the control interface module 200 and the holder 300. Furthermore, the protecting element 208 is further arranged such that when the lighting module 100 is connected to the control interface module 300, it is automatically removed. This may be accomplished by, for example, having a protecting element in the form of a releasable snap-on element, etc.

Even though the invention has been described with reference to specific exemplifying embodiment thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A lighting module having at least one light source and is configured to be fitted to a holder and to a control interface module, wherein the lighting module further comprises:

an outer surface having at least one protruding portion adapted to be provided through a corresponding recess arranged in the holder, electrical contact elements adapted to fit to corresponding electrical connecting elements arranged in the holder for providing electrical power to the lighting module, and a control signal connector, operable independently of said electrical contact elements, adapted to receive a control signal output interface of the control interface module for receiving a control signal to the lighting module, wherein the lighting module is provided with electrical power via the electrical contact elements when the control interface module is not connected.

2. A lighting module as claimed in claim 1, further comprising three spaced apart protruding portions, each protruding portion is positioned circumferentially on the outer surface of the lighting module.

3. A lighting module as claimed in claim 2, wherein the protruding portions are positioned at 120° interval from each other.

4. A lighting module as claimed claim 3, wherein the control signal connector is provided with a protecting element adapted to be automatically removed when the lighting module is fitted to the control interface module.

5. A lighting module as claimed in claim 1, wherein the electrical power is provided to the lighting module by means of mains connectors arranged in the holder.

6. A lighting arrangement comprising the lighting module according to claim 1, and the control interface module, which adapted to receive the lighting module and to be fitted to the holder by means of at least one fixating element provided through the control interface module and into the holder, wherein the holder comprises electrical connecting elements for providing electrical power to the lighting module and mechanical connecting elements for fixating the lighting module, and wherein the control interface module comprises:

an inner surface having at least one recess matching a recess arranged in the holder, wherein the at least one recess is configured to receive a corresponding protruding portion of the lighting module, a control signal input interface, which adapted to receive at least one wire adapted to convey the control signal from a control unit, and the control signal output interface adapted to receive the control signal connector of the lighting module and to provide the control signal to the lighting module.

7. A lighting arrangement as claimed in claim 6, the at least one recess comprising three spaced apart recesses, each recess positioned circumferentially on the inner surface of the control interface module.

8. A lighting arrangement as claimed in claim 7, wherein the three spaced apart recesses are positioned at 120° interval from each other.

9. A lighting arrangement as claimed in claim 8, wherein the control interface module is configured to only allow control of light characteristics of the lighting module.

10. A lighting module as claimed in claim 1, wherein the control signal connector is integrated in said outer surface.

11. A lighting module having at least one light source and is configured to be fitted to a holder and an control interface module, wherein the lighting module further comprises:

an outer surface having at least one protruding portion adapted to be provided through a corresponding recess arranged in the holder, electrical contact elements adapted to fit to corresponding electrical connecting elements arranged in the holder for providing electrical power to the lighting module, and a control signal connector, adapted to receive a control signal output interface of the control interface module for receiving a control signal to the lighting module, wherein the lighting module is provided with electrical power via the electrical contact elements when the control interface module is not connected and wherein the control signal connector is provided with a protecting element adapted to be automatically removed when the lighting module is fitted to the control interface module.

* * * * *